US005850459A

United States Patent [19]

Adachi et al.

[11] Patent Number: 5,850,459

[45] Date of Patent: Dec. 15, 1998

[54] HEADPHONE STEREO CONTROL CIRCUIT

[75] Inventors: Hideaki Adachi; Yukihiro Terada, both of Kanagawa, Japan

[73] Assignee: Mitsumi Electric Co., Ltd., Tokyo, Japan

[21] Appl. No.: 879,634

[22] Filed: Jun. 20, 1997

[30] Foreign Application Priority Data

Jun. 29, 1996 [JP] Japan ..... 8-188325

[51] Int. Cl.[6] ..... H04R 1/10

[52] U.S. Cl. ..... 381/74; 330/307

[58] Field of Search ..... 381/74, 28, 120, 381/309; 330/295, 307, 297, 296, 51

[56] References Cited

U.S. PATENT DOCUMENTS

| | | | |
|---|---|---|---|
| 4,827,221 | 5/1989 | Botti et al. | 330/307 |
| 5,300,892 | 4/1994 | Hirai | 330/307 |
| 5,535,281 | 7/1996 | Gulick | 381/28 |
| 5,760,652 | 6/1998 | Maemura et al. | 330/297 |
| 5,770,973 | 6/1998 | Fujisawa et al. | 330/307 |
| 5,787,182 | 7/1998 | Hoshino et al. | 381/74 |

*Primary Examiner*—Curtis A. Kuntz
*Assistant Examiner*—Xu Mei
*Attorney, Agent, or Firm*—Whitham, Curtis & Whitham

[57] ABSTRACT

A headphone stereo control circuit includes a pre-power amplifier IC 1 wherein a motor speed control circuit 2, a motor driving transistor 3, a pre-amplifier 4 and a main amplifier 5 are mounted. In the headphone stereo control circuit, a headphone motor 6 is connected to the motor output pin P1of the motor driving transistor 3; a stereo head to the stereo head input pin P2 of the pre-amplifier 4; a tuner circuit 8 to the tuner input pin P3 of the main amplifier 5; and a speaker 9 to the main amplifier output pin P4 of the main amplifier 5. Further, a pin P8 for common use in effecting pre-amplifier.speed control is provided, the pin for common use being capable of applying supply voltage simultaneously to the motor speed control circuit 2 and the pre-amplifier 4, so that the supply voltage is supplied via a single-pole change-over switch 12 to the pin P8 for common use in effecting pre-amplifier.speed control.

2 Claims, 1 Drawing Sheet

HEADPHONE STEREO CONTROL CIRCUIT

BACKGROUND OF THE INVENTION

1. Field of the Invention

The present invention relates to audio equipment and more particularly to a portable headphone stereo control circuit.

2. Related Art

As is well known, a portable headphone stereo simultaneously equipped with a tuner such as a radio and a player such as a tape recorder is also equipped with a pre-power amplifier IC 1A in the form of an integrated circuit as shown in FIG. 2.

A motor speed control circuit 2A, a motor driving transistor 3A, a pre-amplifier 4A and a main amplifier 5A are mounted in a pre-power amplifier IC 1A. More specifically, the output of the motor driving transistor 3A in the pre-power amplifier IC 1A is connected to a motor output pin P1; the input terminal of pre-amplifier 4A therein to a stereo head input pin P2; the input terminal of the main amplifier 5A therein to a tuner input pin P3; and the output terminal of the main amplifier 5A therein to a main amplifier output pin P4.

Therefore, in order to make up a headphone stereo control circuit by the use of the pre-power amplifier IC 1A, a ground pin P5 is grounded and further a headphone motor 6A is connected to the motor output pin P1 of the motor driving transistor 3A; a stereo head to the stereo head input pin P2 of the pre-amplifier 4A; a tuner circuit 8A to the tuner input pin P3 of the main amplifier 5A; and a speaker 9A to the main amplifier output pin P4 of the main amplifier 5A. In addition, a stereo mode and a tuner mode can reversibly be switched over by means of a double-throw change-over switch 10 for controlling the application of supply voltage to the motor speed control circuit 2A and the pre-amplifier 4A.

In other words, the double-throw change-over switch 10 is connected among a supply voltage pin P6 for a speed control circuit as the power supply terminal of the motor speed control circuit 2A, a pre-amplifier supply voltage pin P7 as the power supply terminal of the pre-amplifier 4A and a power supply battery, and used for controlling the supply voltage applied to the motor speed control circuit 2A and the pre-amplifier 4A.

In the "tuner mode" in the OFF state of the double-throw change-over switch 10, the supply of driving voltage to the headphone motor 6A is inhibited. Simultaneously, the pre-amplifier 4A is situated in the non-operating state and input from stereo head is suspended, so that input from the tuner circuit 8A can be amplified by the main amplifier 5A. In the "stereo mode" in the ON state of the double-throw change-over switch 10, the tuner circuit 8A is separated from the pre-power amplifier IC 1A and because the motor speed control circuit 2A and the pre-amplifier 4A are situated in the operating state, the headphone motor 6A is operated so as to make the pre-amplifier 4A amplify an input signal from the stereo head 7A.

However, the use of such a double-throw change-over switch 10 which is complicated in structure and expensive in the above-described conventional headphone stereo control circuit makes the circuit comparatively high in production cost. Since the supply voltage pin P6 for a speed control circuit and the pre-amplifier supply voltage pin P7 are simultaneously provided in the motor speed control circuit 2A, the number of connector pins for use in coupling the these pins and the double-throw change-over switch 10 increases, which may raise the problem of increasing imperfect contacts.

SUMMARY OF THE INVENTION

In view of the foregoing problems attributed to the above-described conventional headphone stereo control circuit, it is an object of the present invention to provide a headphone stereo control circuit capable of making the number of pins of a pre-power amplifier IC as small as possible while dispensing with a double-throw change-over switch which entails high production cost.

In order to accomplish the object above, proposed is a headphone stereo control circuit comprising a pre-power amplifier IC wherein a motor speed control circuit, a motor driving transistor, a pre-amplifier and a main amplifier are mounted and wherein a headphone motor is connected to the motor output pin of the motor driving transistor; a stereo head to the stereo head input pin of the pre-amplifier; a tuner circuit to the tuner input pin of the main amplifier; and a speaker to the main amplifier output pin of the main amplifier, characterized by the provision of a pin for common use in effecting pre-amplifier.speed control, the pin for common use being capable of applying supply voltage simultaneously to the motor speed control circuit and the pre-amplifier, so that the supply voltage is supplied via a single-pole change-over switch to the pin for common use in effecting pre-amplifier.speed control.

DETAILED DESCRIPTION OF THE PREFERRED EMBODIMENTS

A detailed description will subsequently be given of an embodiment of the present invention with reference to FIG. 1.

Figure 1:
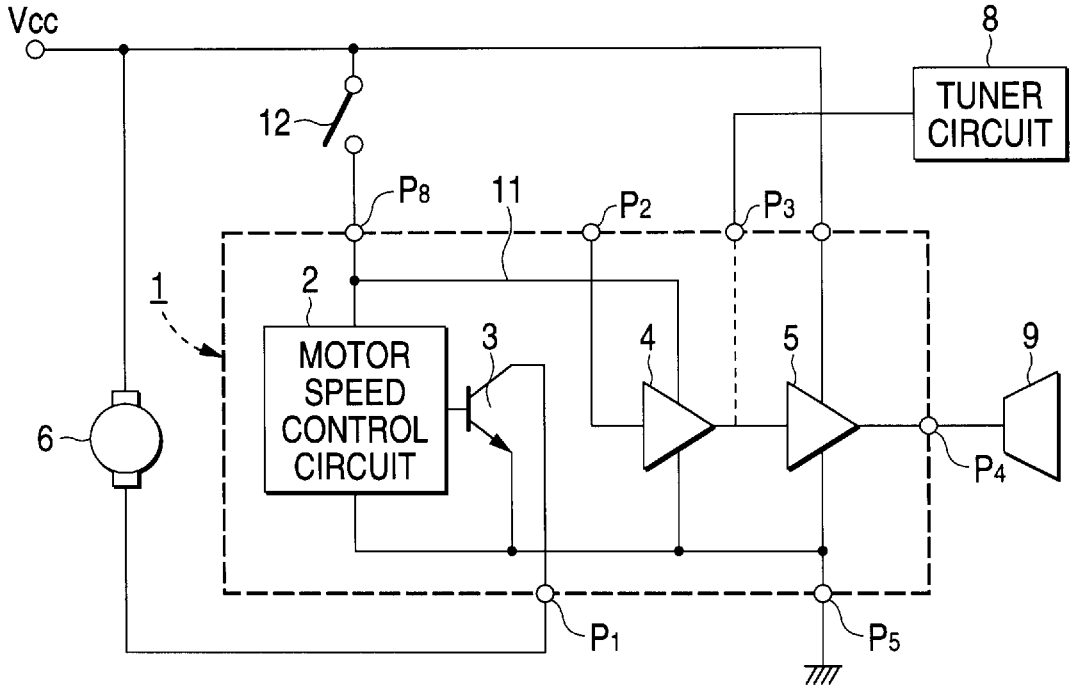
FIG. 1 is a circuit diagram of a headphone stereo control circuit according to the present invention.
Figure 2:
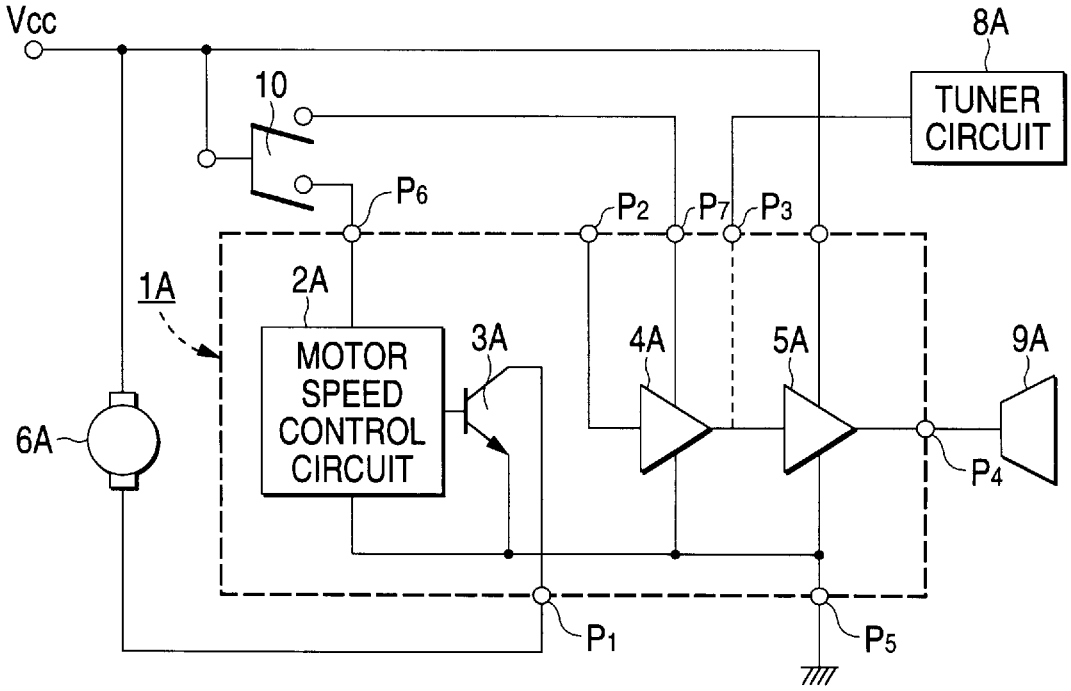
FIG. 2 is a circuit diagram of a conventional headphone stereo control circuit.

FIG. 1 is a circuit diagram similar to the circuit diagram of the above-described conventional headphone stereo control circuit with reference to FIG. 2 in respect of using a pre-power amplifier IC 1 in which a motor speed control circuit 2, a motor driving transistor 3, a pre-amplifier 4 and a main amplifier 5. More specifically, the output of the motor driving transistor 3 in the pre-power amplifier IC 1 is connected to a motor output pin P1; the input terminal of pre-amplifier 4 therein to a stereo head input pin P2; the input terminal of the main amplifier 5 therein to a tuner input pin P3; and the output terminal of the main amplifier 5 therein to a main amplifier output pin P4.

Moreover, the ground pin P5 of the pre-power amplifier IC 1 is grounded. Further, a headphone motor 6 is connected to the motor output pin P1 of the motor driving transistor 3; a stereo head to the stereo head input pin P2 of the pre-amplifier 4; a tuner circuit 8 to the tuner input pin P3 of the main amplifier 5; and a speaker 9 to the main amplifier output pin P4 of the main amplifier 5. The headphone stereo control circuit is thus arranged.

According to the present invention, a connection 11 is used for putting the supply voltage portion of the pre-amplifier 4 and that of the motor speed control circuit 2 to common use in the pre-power amplifier IC 1, so that these supply voltage portion may be connected to the outside via a pin P8 for common use in effecting pre-amplifier.speed control. In other words, what is featured by the present invention is that a stereo mode and a tuner mode can reversibly be switched over by means of a single-pole change-over switch 12 which is connected to the pin P8 for common use in effecting pre-amplifier.speed control.

Since the present invention has been embodied as shown in FIG. 1, the stereo and tuner modes can be switched over by means of the single-pole change-over switch 12.

When the single-pole change-over switch 12 is turned off, the "tuner mode" is established and the supply of driving voltage to the headphone motor 6 is inhibited. Simultaneously, the pre-amplifier 4 is situated in the non-operating state and input from stereo head is suspended, so that input from the tuner circuit 8 is amplified by the main amplifier 5. In the "stereo mode" in the ON state of the single-pole change-over switch 12, the tuner circuit 8 is separated from the pre-power amplifier IC 1 and because the motor speed control circuit 2 and the pre-amplifier 4 are situated in the operating state, the headphone motor 6 is operated so as to make the pre-amplifier 4 amplify an input signal from the stereo head 7.

The single-pole change-over switch 12 for used according to the present invention is simple in construction and available inexpensively and besides the number of pins in the pre-power amplifier IC 1 is reducible. Since not only the number of pins of the connecting connector but also the possibility of imperfect contacts is also reducible, the reliability of the control circuit according to the present invention is made improvable thereby.

As is obvious from the description given above, according to the present invention, the pin for common use in effecting pre-amplifier.speed control, that is, the pin capable of simultaneously applying the supply voltage to the motor speed control circuit and the pre-amplifier is provided and the supply voltage is supplied to the pin for common use in effecting pre-amplifier.speed control via the single-pole change-over switch. Consequently, the production cost is made reducible by the use of such an inexpensive pin for common use in effecting pre-amplifier-speed control and the reliability of the control circuit is also improvable as the number of pins of the pre-power amplifier IC-is decreased to lower the possibility of defective contacts.

What is claimed is:

1. A headphone stereo control circuit comprising:

a pre-power amplifier IC including a motor speed control circuit, a motor driving transistor, a pre-amplifier and a main amplifier;

a headphone motor connected to the motor output pin of the motor driving transistor;

a stereo head connected to the stereo head input pin of the pre-amplifier;

a tuner circuit connected to the tuner input pin of the main amplifier;

a speaker connected to the main amplifier output pin of the main amplifier; and a pin for common use in effecting pre-amplifier and speed control, the pin for common use capable of applying supply voltage simultaneously to the motor speed control circuit and the pre-amplifier.

2. A headphone stereo control circuit as claimed in claim 1, wherein the supply voltage is supplied via a single-pole change-over switch to the pin for common use in effecting pre-amplifier·speed control.

* * * * *